United States Patent [19]

Brackmann

[11] Patent Number: 4,793,367

[45] Date of Patent: Dec. 27, 1988

[54] LINEAR LAYERED CIGARETTE

[75] Inventor: Warren A. Brackmann, Mississauga, Canada

[73] Assignee: Rothmans of Pall Mall Canada Limited, North York, Canada

[21] Appl. No.: 935,214

[22] Filed: Nov. 26, 1986

[30] Foreign Application Priority Data

Dec. 4, 1985 [GB] United Kingdom ..... 8529851

[51] Int. Cl.[4] ..... A24D 1/00; A24F 1/00; A24C 5/14; A24C 5/39

[52] U.S. Cl. ..... 131/360; 131/364; 131/84.1; 131/84.4

[58] Field of Search ..... 131/360, 364, 84.1, 131/84.2, 84.3, 84.4

[56] References Cited

U.S. PATENT DOCUMENTS 435,510 9/1890 Meyer ..... 131/364
1,829,559 10/1931 Gilliam ..... 131/364

FOREIGN PATENT DOCUMENTS 0011459 12/1899 United Kingdom ..... 131/364

*Primary Examiner*—V. Millin
*Attorney, Agent, or Firm*—Sim & McBurney

[57] ABSTRACT

A novel cigarette structure is provided which permits a cigarette of lower tar to be provided without impairing the flavor. Strips of more highly-flavored tobacco are provided on opposite sides and sandwich a layer of lesser-flavored tobacco between them.

6 Claims, 2 Drawing Sheets

LINEAR LAYERED CIGARETTE

FIELD OF THE INVENTION

The present invention relates to a novel cigarette structure wherein tobacco in the cigarette is arranged to provide desired smoking characteristics.

BACKGROUND TO THE INVENTION

It is well known, for example, from U.S. Pat. No. 1,829,559, to form cigarettes of two or more different types of smoking materials, wherein one type of smoking material predominates in an inner core while another type of smoking material predominates in an outer annulus totally surrounding and enclosing the core.

It is also well known that a substantial proportion of the tobacco smoke entering a smoker's mouth results from the burning of tobacco in the peripheral regions of the cigarette. It is estimated that about 80% of the volume of smoke entering the smoker's mouth originates from only about 50% of the weight of tobacco in the cigarette.

It is further well known that, when a cigarette is first lit up, smoke from the burning of tobacco material in the whole cross-section of the cigarette is drawn into the smoker's mouth and not predominantly from the burning of annulus material, thereby producing a different taste for the smoker upon lighting up of such prior art composite cigarettes.

This particular problem of prior art composite cigarettes has been solved. In copending U.S. patent application Ser. No. 862,202 filed May 13, 1986, assigned to the assignee hereof and the disclosure of which is incorporated herein by references, there is described a cigarette in which additional quantities of the annulus material are provided in the lighting end of the cigarette, so that, upon the cigarette being lit, the smoke reaching the mouth of the smoker is derived mainly from annulus material. In this way, little or no change in the taste of the tobacco smoke is perceived by the smoker as the burning proceeds from light up to continued smoking.

In prior art composite cigarettes, the emphasis has been on using a core of poor quality tobacco and an annulus of higher quality tobacco. It is essential to the effectiveness of such composites for the poorer quality tobacco to be surrounded by and enclosed within the annulus of higher quality tobacco, in view of the poor smoking characteristics of the poorer quality tobacco contemplated for such cigarettes. While economies in tobacco usage are achieved, these structures do not, in any way, address questions of taste and tar content of the tobacco smoke.

Currently, the trend in cigarettes is towards cigarettes with lower tar levels in cigarette smoke. However, such lesser tar levels generally have also resulted in lower levels of flavour, which is considered undesirable by certain smokers. Prior attempts to increase flavour with lower tar cigarettes have included the use of flavouring additives.

SUMMARY OF INVENTION

The present invention provides a simple yet very effective way of increasing the flavour of cigarette smoke without an increase in tar and without the necessity for the use of additives. It has now been found that it is unnecessary for the outer "annulus" tobacco to completely surround the "core" tobacco in order to provide good overall smoking characteristics.

In accordance with the present invention, a novel cigarette structure is provided which provides unique burning characteristics. In this invention, there is provided a cigarette comprising a laminate of two relatively-thin outer layers of a first grade of tobacco material and a relatively thick layer of a second tobacco material located therebetween.

GENERAL DESCRIPTION OF INVENTION

Figure 1:
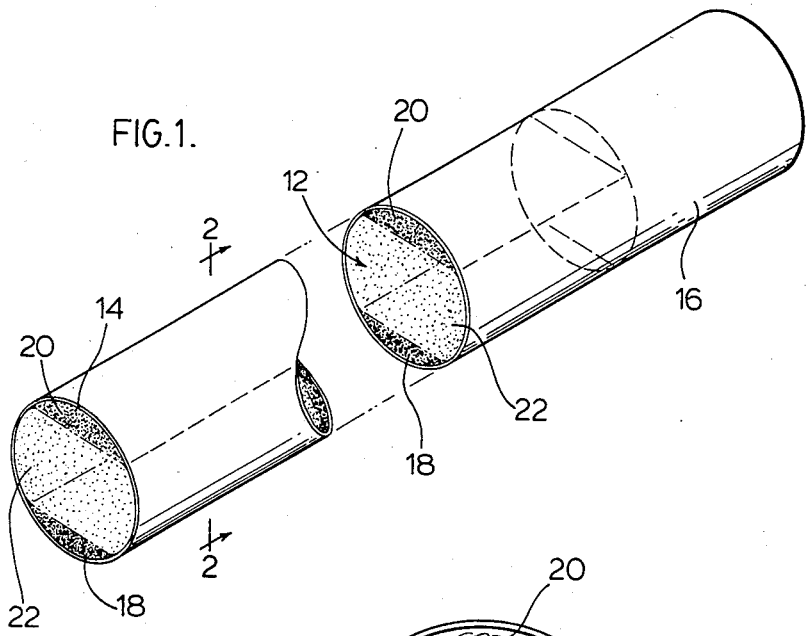
FIG. 1 is a schematic perspective view, partially cut away to show detail, of a cigarette provided in accordance with one embodiment of the invention.

The cigarettes provided in accordance with this invention preferably utilize cut tobacco lamina in each layer of the laminate but blended differently to provide different flavour characteristics in the respective layers. In a preferred embodiment, these different flavour characteristics are combined with different flavour/tar ratios.

In accordance with a particularly preferred embodiment of the invention, the tobacco in the outer layers has a greater ratio of flavour to tar than the tobacco in the intermediate layer. By selecting tobacco from differing portions of a tobacco plant, this result may be achieved. Generally, leaves from the upper part of the tobacco plant have a higher flavour/tar ratio than leaves from the lower part of the tobacco plant. In blending the tobacco for inclusion in the cigarettes of the invention, the higher flavour/tar ratio tobacco normally included in the blend is maintained as a separate blend.

The result of placing the higher flavour/tar ratio tobacco in the outer layers of the laminate is an increase in taste to the smoker, since the flavour originates predominantly from the peripheral regions of the cigarette, as mentioned above. This increased taste is achieved with no perceptible increase in the total tar produced by the cigarette. Conversely, the same overall level of flavour or taste can be achieved at a lower tar level.

In this way, the present invention enables the flavour of cigarette smoke to be increased simply yet effectively without an increase in tar. This result is in complete contrast to the prior art.

The present invention generally employs the same shredded lamina material which usually is employed in cigarettes, but with outer layers of higher flavour/tar ratio shredded lamina material than the intermediate shredded lamina material. The cigarette of the invention, therefore, is very familiar to a standard cigarette with respect to the tobacco employed, except for the outer strips of highly-flavoured tobacco material. With this arrangement, it is unnecessary that the outer layers in the linear layered cigarette enclose the intermediate tobacco, thereby considerably simplifying the rod-forming procedure. In addition, the quantity of tobacco in the outer layers or strips may be varied to alter the overall flavour of the cigarette.

This arrangement of the different types of tobacco material and the reasons therefor are quite different from the prior art composite cigarettes where tobacco material not normally employed as filler rod material forms a core which must be surrounded by an annulus of smoking quality tobacco.

The filler rod of the cigarettes of the invention may be formed in any convenient manner. One relatively simple procedure is a variation of conventional continuous rod-forming techniques. Conventionally, a filler rod is formed from a shower of tobacco particles by passing a filler rod-forming and -conveying surface transverse thereto and trimming excess tobacco from one side of the rod, prior to compression and wrapping in paper. The trimmed tobacco may be recycled within the cigarette making machine to form a tobacco layer on the opposite side of the filler rod from the trimmed side.

Figure 3:
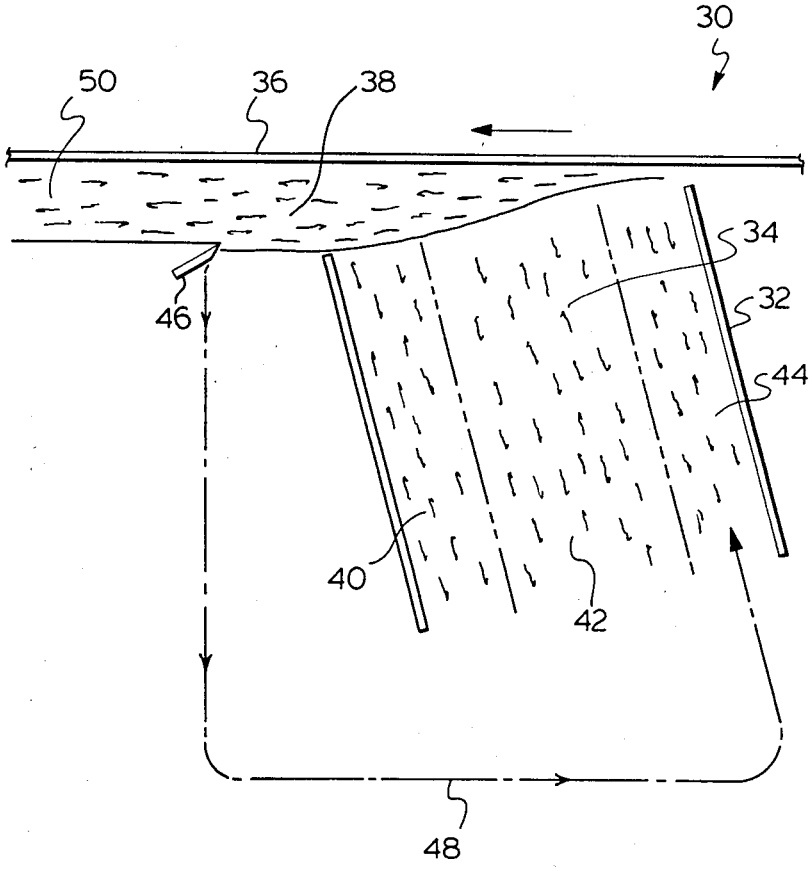
FIG. 3 is a schematic sectional view of a cigarette rod-forming apparatus for carrying out the rod-forming procedure of the invention.

Specifically referring to FIG. 3, there is shown therein a trimmed cigarette rod-forming apparatus 30 having an upwardly-extending tobacco shower guide 32 for leading a shower of tobacco particles 34 upwardly against the underside of a transversely-moving rod-forming belt 36.

As the belt 36 moves laterally with respect to the tobacco shower 34, a filler rod 38 is built up on the undersurface of the belt 36. The shower 34 is comprised of a first side portion 40 of more highly-flavoured tobacco particles, a central portion 42 of less highly-flavoured tobacco particles and a second side portion 44 of recycled trimmed tobacco.

The filler rod 38 is formed with more tobacco than is ultimately required in the cross-section of the rod, and the excess tobacco is trimmed from the rod by a trimmer 46. Since the more highly-flavoured is provided in the side portion 40 of the shower 34 and this tobacco is laid-down last on the filler rod 38, a layer of the highly-flavoured tobacco is on the side of the filler rod 38 facing the trimmer.

The more highly-flavoured tobacco which is trimmed from the filler rod by the trimmer 46 is collected and recycled by line 48 and is placed in the side portion 44 of the shower 34, so that it forms a layer in the filler rod 36 on the opposite side of the rod from the layer of highly-flavoured tobacco in side portion 40. In this way, the final trimmed rod 50 has a layer of shower 42 sandwiched between outer layers of more highly-flavoured tobacco.

The latter technique may be employed to form the linear layered cigarette of this invention, with the tobacco trimmed from one layer of the highly-flavoured tobacco being used to provide the tobacco in the layer on the opposite side of the laminate.

The trimming of highly-flavoured tobacco from one side of the tobacco rod and placing the trimmed tobacco on the opposite side of the rod to provide the laminate may be combined with a dense ending technique to provide an increased quantity of the highly-flavoured tobacco in the lighting end of the cigarette, thereby increasing the flavour of the first puff, as well as providing the other improved smoking characteristics achieved by the present invention.

Conventional dense ending techniques include the use of a rotary cutter for trimming which has a pocket in it to trim a lesser thickness of tobacco as the cigarette end segment passes the cutting point. Instead of varying the height of the tobacco trimming location, the tobacco segment just prior to the trimming point may be compressed, for example, with a rotary compression device having lobes which mechanically compress the tobacco towards the rod-carrying surface.

During the smoking of a cigarette, the quantity of flavour components in the smoke tends to increase as the cigarette is smoked, so that the last puffs usually contain approximately three times the amount of flavour components than the first puff. It is possible to vary the cross-sectional relative proportions of tobacco in the outer layers and the intermediate layer along the length of the cigarette, so as to provide a more uniform distribution of smoking characteristics along the length of the cigarette.

DESCRIPTION OF PREFERRED EMBODIMENTS

Figure 2:
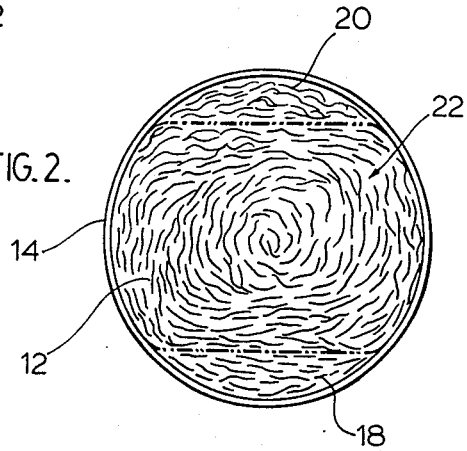
FIG. 2 is a sectional view taken on line 2—2 of FIG. 1.

Referring to the drawings, FIGS. 1 and 2 illustrate schematically a novel cigarette 10 provided in accordance with one embodiment of the invention. A tobacco filter rod 12 is enclosed within an outer paper tube 14 with a filter 16 provided at the smoking end.

In accordance with the present invention, the filter rod 12 comprises a laminate of two outer layers 18 and 20 of a first grade of tobacco and a relatively thick layer 22 of a second grade of tobacco located between the outer layers 18 and 20.

SUMMARY OF DISCLOSURE

In summary of this disclosure, the present invention provides a novel cigarette structure which enables the smoking characteristics of a cigarette to be modified, in particular to increase the flavour of tobacco smoke for the same tar level, to decrease the tar level for the same flavour of tobacco smoke, or to combine these characteristics. Modifications are possible within the scope of this invention.

What I claim is:

1. A novel cigarette having a filler rod within a paper tube, comprising a laminate of two outer layers of a first tobacco material and a relatively thick layer of a second tobacco material located therebetween.

2. The cigarette of claim 1 wherein the tobacco material in each layer of said laminate comprises cut tobacco lamina material, with the cut lamina material in said relatively thick layer being of a different blend from the cut lamina material in said outer layers.

3. The cigarette of claim 2 wherein said different tobacco blends in said relatively thick layer and in said outer layers have different flavour/tar ratios.

4. A novel cigarette having a filler rod within a paper tube, comprising a laminate of two outer layers of a first tobacco material and a relatively thick layer of a second tobacco material located therebetween, the tobacco material in each layer of said laminate comprising cut tobacco lamina material, with the cut lamina material in said relatively thick layer being of a different blend from the cut lamina material in said outer layers, the tobacco blend in said outer layers having a greater ratio of flavour to tar ratio than the tobacco blend in said relatively thick layer.

5. The cigarette of claim 4 wherein the relative proportions of said higher flavour tobacco material to said lesser flavour tobacco material decreases along the length of the cigarette from a lighting end thereof.

6. A method of forming a trimmed tobacco filler rod, which comprises:

moving a filler rod-forming and -conveying surface transverse to a shower of tobacco particles having a first side portion in the upstream direction of said surface, a middle portion and a second side portion in the downstream direction of said surface and wherein more highly-flavoured tobacco than in said middle portion thereof is provided in one of said first and said second sides of said shower, so as to form a tobacco filler rod having an excess quantity of tobacco over that generally desired in the cross-section thereof with a layer of said more highly-flavoured tobacco on one side of said rod.

trimming said excess quantity of tobacco from said layer of more highly-flavoured tobacco, and recycling said trimmed tobacco to the other side of said first and second sides of said shower opposite to said one of said first and second sides, whereby said trimmed filler rod comprises a layer of more highly-flavoured tobacco on each side thereof with a layer of less highly-flavoured tobacco sandwiched therebetween.

* * * * *